US009795197B2

(12) United States Patent
Rizzuto

(10) Patent No.: US 9,795,197 B2
(45) Date of Patent: Oct. 24, 2017

(54) PERSONAL ACCESSORY APPARATUS

(71) Applicant: Conair Corporation, Stamford, CT (US)

(72) Inventor: Leandro P Rizzuto, Sheridan, WY (US)

(73) Assignee: Conair Corporation, Stamford, CT (US)

( * ) Notice: Subject to any disclaimer, the term of this patent is extended or adjusted under 35 U.S.C. 154(b) by 0 days.

(21) Appl. No.: 14/643,530

(22) Filed: Mar. 10, 2015

(65) Prior Publication Data

US 2016/0262503 A1 Sep. 15, 2016

(51) Int. Cl.

| | |
|---|---|
| ***A45C 5/00*** | (2006.01) |
| ***A44C 27/00*** | (2006.01) |
| ***A45D 8/34*** | (2006.01) |
| ***A44C 5/00*** | (2006.01) |
| *A45D 8/00* | (2006.01) |

(52) U.S. Cl.

CPC ..... *A44C 5/0007* (2013.01); *A44C 5/0053* (2013.01); *A44C 27/00* (2013.01); *A45D 8/34* (2013.01); *A45D 2008/004* (2013.01)

(58) Field of Classification Search

CPC .... A41D 20/00; A41D 20/005; A44C 5/0007; A45D 8/34; A63B 21/065; B68B 5/04

USPC ..... 132/275; 485/105, 124, 125; 482/105, 482/124, 125

See application file for complete search history.

(56) References Cited

U.S. PATENT DOCUMENTS

| | | | | |
|---|---|---|---|---|
| 4,623,143 | A * | 11/1986 | Wuellenweber ..... | A63B 21/065 482/105 |
| 5,073,989 | A * | 12/1991 | Teague ..... | F16G 11/02 2/181 |
| 5,230,355 | A | 7/1993 | Weingrod | |
| 5,305,470 | A * | 4/1994 | McKay ..... | A41D 20/005 2/170 |
| 5,456,274 | A | 10/1995 | Selbee et al. | |

(Continued)

OTHER PUBLICATIONS

Ben Franklin Crafts, "How to Make Bungee Cord Jewelry: Bracelets & Necklace", Jul. 19, 2014, Heavy Bits Incorporated, p. 1-17 <https://snapguide.com/guides/make-bungee-cord-jewelry-bracelets-necklace/>.*

(Continued)

*Primary Examiner* — Todd E Manahan
*Assistant Examiner* — Jennifer Gill
(74) *Attorney, Agent, or Firm* — Lawrence Cruz, Esq.; Joseph W. Schmidt, Esq.

(57) ABSTRACT

A convertible fashion accessory item has a first condition in the form of a bracelet, anklet, necklace or other looped jewelry item, and at least a second condition in the form of a hair or ponytail holder. The accessory apparatus includes an outer elastic member and at least one inner elastic member disposed within the outer elastic tubular member with the at least one inner elastic member defining a hollow interior. The accessory apparatus may include first and second inner elastic members. The first inner elastic member may include filler material within the hollow interior thereof. Alternatively, each of the first and second inner elastic members includes filler material within the hollow interiors thereof. The filler material includes filler yarns or threads, or foam. A decorative element, in the form of, e.g., a chain, may be mounted about the outer elastic member.

10 Claims, 5 Drawing Sheets

(56) References Cited

U.S. PATENT DOCUMENTS

| | | | | |
|---|---|---|---|---|
| 5,758,671 | A * | 6/1998 | Thim | A45D 8/34 132/273 |
| D400,100 | S | 10/1998 | Minard | |
| 5,826,598 | A | 10/1998 | Meehan | |
| 5,946,728 | A | 9/1999 | Tane | |
| 6,023,786 | A | 2/2000 | Burnett | |
| 6,105,837 | A | 8/2000 | Teed | |
| D441,501 | S | 5/2001 | Mensonides | |
| 6,263,884 | B1 | 7/2001 | Minnelli | |
| D447,078 | S | 8/2001 | Avakian | |
| 6,435,194 | B1 | 8/2002 | Babay | |
| 6,470,896 | B1 | 10/2002 | Mensonides | |
| 6,499,144 | B1 * | 12/2002 | Yan | A42B 1/22 2/181.2 |
| D474,990 | S | 5/2003 | Montanari | |
| 6,560,993 | B1 | 5/2003 | Bosque et al. | |
| 6,561,958 | B2 * | 5/2003 | Pappert | A63B 21/06 482/105 |
| 6,647,746 | B2 | 11/2003 | Bosque et al. | |
| 7,174,901 | B2 | 2/2007 | Haar et al. | |
| D550,399 | S | 9/2007 | Lee | |
| 7,383,588 | B2 * | 6/2008 | Victor | A41D 20/00 2/16 |
| D605,276 | S | 12/2009 | Beardmore | |
| D637,936 | S | 5/2011 | Modi | |
| 8,308,616 | B1 * | 11/2012 | Flavell | A63B 21/0603 482/10 |
| D718,494 | S | 11/2014 | Dula | |
| 9,138,024 | B1 | 9/2015 | Solomon | |
| 2005/0137063 | A1 * | 6/2005 | Abdo | A63B 21/0004 482/105 |
| 2006/0150997 | A1 * | 7/2006 | Stephens | A45D 8/34 132/273 |
| 2006/0157077 | A1 * | 7/2006 | Kraft | A45D 8/34 132/200 |
| 2008/0274858 | A1 * | 11/2008 | Flavell | A63B 21/065 482/10 |
| 2011/0009713 | A1 * | 1/2011 | Feinberg | A61B 5/0205 600/301 |
| 2012/0234344 | A1 * | 9/2012 | Hsu | A45D 8/36 132/273 |
| 2013/0186134 | A1 | 7/2013 | Goldstein | |
| 2013/0186424 | A1 * | 7/2013 | Zachery | A45D 8/34 132/275 |
| 2014/0202482 | A1 * | 7/2014 | Didieu | A45D 8/00 132/200 |
| 2015/0090288 | A1 * | 4/2015 | Chudzik | A45D 8/34 132/273 |
| 2016/0213120 | A1 * | 7/2016 | Sze | A45D 8/34 |

OTHER PUBLICATIONS

Gale, Thomas, "Bungee Cord", Apr. 10, 2006, Thomson Corporation, p. 1-8, <http://www.madehow.com/Volume-2/Bungee-Cord.html>.*

"Exploring Bungee", copyright 1997, http://www.bungee.it/engineering/bcords_e.html.*

Swarovski Stardust Mesh Wrap Bracelet, earliest date available Jan. 2, 2015, online. Visited on Jun. 8, 2016. Internet URL:<"http://www1.macys.com/shop/product/swarovski-stardust-mesh-wrap-bracelet?ID-1621135">.

18K Rose Gold Silver Diamon Cut Wide Mesh Bracelet Nib, earliest date available Apr. 2, 2011, online. Visited on Jun. 8, 2016. Internet URL:<"http://www.ebay.com.au/itm/18K-ROSE-GOLD-SILVER-DIAMOND-CUT-WIDE-MESH-BRACELET-NIB-/110669515638">.

* cited by examiner

PERSONAL ACCESSORY APPARATUS

TECHNICAL FIELD

The present disclosure relates to a personal accessory apparatus, and more particularly, relates to a convertible accessory apparatus having multiple applications including uses as a bracelet, an anklet and/or hair retainer.

BACKGROUND

Fashion items such as bracelets, anklets, headbands and ponytail or braid holders are well known in the art. These items are inclusive of elastic bands, scrunches, ribbons, rings etc. A conventional bracelet or ponytail holder may be in the form of an elastic band including, e.g., a solid rubber band or a woven elastic band. Conventional elastic bracelets exhibit minimal flexibility to be retained on the wrist without constricting. On the other hand, hair retainers including ponytail holders, particularly, those intended to be looped a number of times about a ponytail are relatively flexible to facilitate positioning of the holder about the hair.

In general, conventional bracelets and hair retainers or ponytail holders are effective for their intended purposes. However, due to their respective constructions, these devices are incapable of being used in multiple applications. For example, known bracelets, even elastic type bracelets, are sufficiently rigid so as to maintain a non-constrained single looped configuration about the wrist of a subject. The rigidity of these bracelets precludes their use in retaining hair. Known hair retainers or ponytail holders are flexible for wrapping about the hair multiple times, and thus, would not present properly on the wrist if attempted to be used as a bracelet.

SUMMARY

Accordingly, the present disclosure is directed to a convertible fashion accessory item having a first condition in the form of a bracelet, anklet, necklace or other looped jewelry item, and at least a second condition in the form of a hair or ponytail holder. In one embodiment, the accessory apparatus includes an outer elastic member and at least one inner elastic member disposed within the outer elastic member with the at least one inner elastic member defining a hollow interior. The accessory apparatus may include first and second inner elastic members. The first inner elastic member may include filler material within the hollow interior thereof. Alternatively, each of the first and second inner elastic members includes filler material. The filler material may include filler yarns or threads and/or foam.

The apparatus may include a decorative element mounted about the outer elastic member. The decorative element may include a chain wrapped about the outer elastic member. The chain has first and second end segments and a mid-segment disposed between the first and end segments. At least the first and second end segments are secured relative to the outer elastic member. A plurality of fasteners may be mounted to the first and second end segments of the chain and secured relative to the outer elastic member. Each fastener may be dimensioned to span at least two adjacent turns of the chain.

At least one weight may be mounted to one of the decorative element or the outer elastic member. In one embodiment, the at least one weight is mounted to the outer elastic member in general diametrical opposed relation to the decorative element to facilitate outward presentation of the decorative element when the accessory apparatus is worn as a bracelet or anklet.

The outer elastic member and the at least one inner elastic member each may be a continuous band. The outer elastic member and the at least one inner elastic member may be dimensioned to be worn on a wrist in a single loop configuration and about a ponytail in a multi-loop configuration.

In another embodiment, a convertible bracelet/hair retainer includes a convertible continuous band having sufficient flexibility to transition between a single-loop bracelet and a multi-looped hair retainer. The convertible band includes a continuous outer elastic member, and first and second continuous inner elastic members disposed within the outer elastic member. At least one of the first and second elastic inner elastic members defines a hollow interior having filler material disposed therein. Each of the first and second elastic inner elastic members may define a hollow interior with filler material disposed therein. In one embodiment, a decorative element is mounted about the outer elastic member. The decorative element includes a chain wrapped about the outer elastic member, e.g., in a helical manner.

In one embodiment, a method for forming an accessory device is disclosed. The method includes:

wrapping a decorative element about an outer elastic member of an accessory device, the accessory device including at least one inner elastic member disposed within the outer elastic tubular member; and securing end segments of the decorative element to the outer elastic member with a plurality of fasteners.

The decorative element may include a chain and wherein securing end segments includes securing the fasteners relative to adjacent turns of the chain by, e.g., stitching the fasteners about adjacent turns of the chain.

The construction of the outer and inner elastic members of the accessory apparatus provides a device that possesses sufficient rigidity to be worn on the wrist while maintaining its single looped configuration, and also exhibits sufficient flexibility to be looped about hair (e.g., a ponytail) to function as a hair retainer or ponytail holder. The accessory apparatus is capable of transitioning between the single loop and multi-loop configurations with relative ease and effort required on behalf of the subject without affecting the structural integrity of the apparatus. Further details and advantages of the outer and inner elastic members will be appreciated from the following written description.

BRIEF DESCRIPTION OF THE DRAWINGS

Embodiments of the present disclosure will be readily appreciated by reference to the drawings wherein.

DETAILED DESCRIPTION

Figure 1:
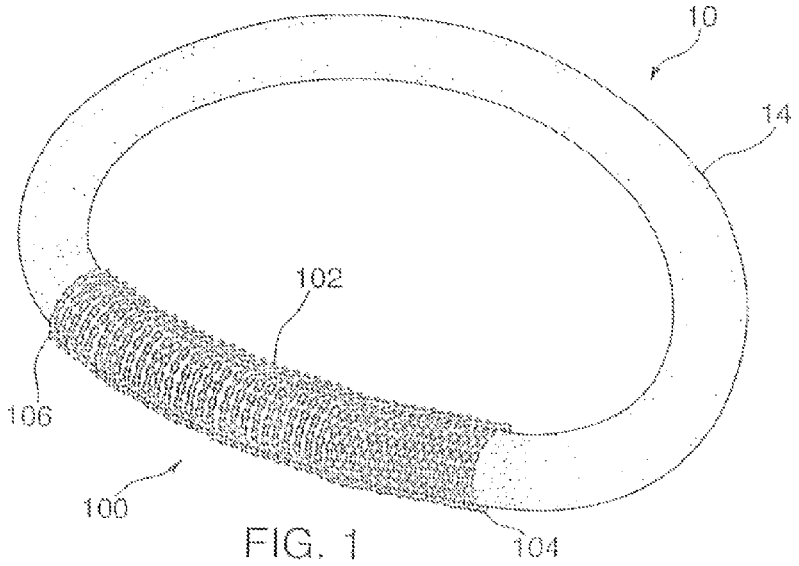
FIG. 1 is a perspective view of the personal accessory apparatus in accordance with the principles of the present disclosure illustrating the outer band and the decorative element.

Referring initially to FIG. 1, the accessory apparatus 10 in accordance with the principles of the present disclosure is illustrated. The accessory apparatus 10 is adapted to convert or transform between various functionalities. For example, the accessory apparatus 10 may, in a first condition, be in the form of a wristlet, anklet or bracelet, and in a second condition, be in the form of a hair holder or retainer (e.g., a ponytail holder or braid holder). Various other fashion applications for the accessory apparatus 10 are also envisioned. In FIG. 1, the accessory apparatus includes a decorative element 100. The decorative element 100 may be a jewelry item including a chain, arrangement of precious stones or the like. Further details of the decorative element 100 and one methodology of mounting or assembly with the remaining components of the accessory apparatus will be discussed in greater detail hereinbelow.

Figure 2:
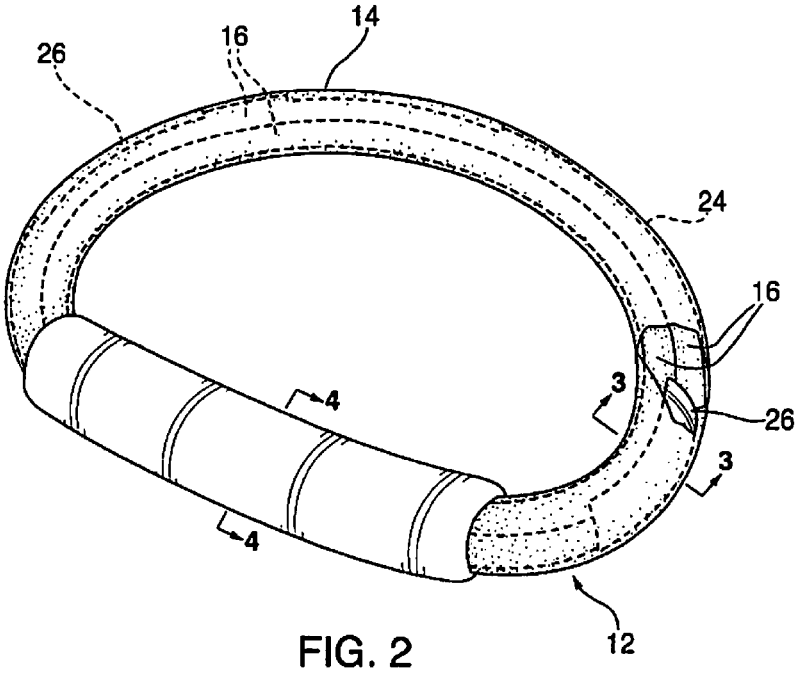
FIG. 2 is a perspective view of the personal accessory apparatus of FIG. 1 with portions of the outer band removed and the decorative element schematically illustrated.
Figure 3:
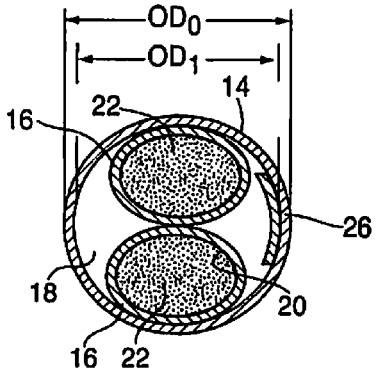
FIG. 3 is a cross-sectional view of the accessory apparatus taken along the lines 3-3 of FIG. 2 illustrating the outer elastic member and the first and second inner elastic members of the outer band.
Figure 4:
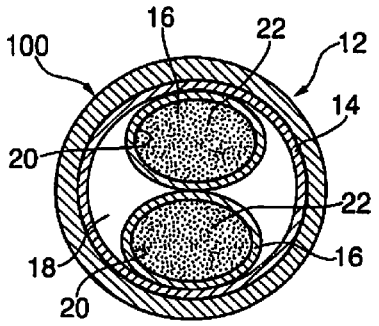
FIG. 4 is a cross-sectional view of the accessory apparatus taken along the lines 4-4 of FIG. 2 illustrating the relationship of the decorative element and the outer and inner elastic members.

Referring now to FIG. 2, in conjunction with the cross-sectional views of FIGS. 3-4, the accessory apparatus 10 will be discussed. In FIGS. 2-4, the decorative element 100 is schematically depicted. The accessory apparatus 10 includes a continuous band 12 having an outer band or elastic member 14 and at least one, e.g., two or more, inner bands or inner elastic members 16. The outer elastic member 14 may be substantially tubular defining an interior volume 18 which accommodates the inner elastic members 16. In one embodiment, the outer elastic member 14 is a continuous band or loop having a predefined length in its normal or rest condition. In the alternative, the outer elastic member 14 may be discontinuous and connected to each other or within the continuous band 12 through conventional means including stitching, adhesives or the like. The outer elastic member 14 may be fabricated from a number of materials including woven or braided fabrics having elastic characteristics such that the outer elastic member 14 can expand along its length upon application of a force and return to its predefined length upon removal of the force. The outer elastic member 14 may be constructed from a non-woven material and have the capability of expanding or stretching upon application of a force. For example, in one embodiment, the outer elastic member 14 may be fabricated as a braid or weave from materials including organic chemistry compositions either synthetic or derived from natural fibers. Such materials include wool, cotton, hemp, linen, polyester, acrylic, polyethylene, polypropylene, Nylon, polyamides.

The outer elastic member 14 may define various cross-sectional shapes including circular, oval and/or polygonal configurations. In the embodiment shown in FIGS. 1-3, the outer elastic member 14 is circular and defines an outer diameter or cross-sectional dimension $OD_O$ and an inner dimension $OD_I$. $OD_O$ may range from about a ⅛ inch to about 1 inch although other dimensions are also envisioned. The diameter or cross-sectional dimension $OD_O$ of the outer elastic member 14 may be constant throughout its length or may vary along its length. The inner dimension or diameter $OD_I$ is dependent on the thickness of the wall of the outer elastic member 14. In one embodiment, the inner dimension $OD_I$ is slightly less than the outer dimension $OD_O$.

The inner elastic members 16 each may be substantially tubular and define a hollow interior 20. The hollow interior 20 may be at least partially filled with filler material 22 such as strands of yarn, thread and/or foam. Suitable filler materials 22 include cotton, silk linen, synthetic fibers, polyethylene foam, polyurethane foam or the like. The inner elastic members 16 may be elastic to stretch along its length upon application of a force and return to its original looped configuration upon removal of the force. The inner elastic members 16 may be fabricated from a similar material(s) (listed hereinabove) to that of the outer elastic member 14. The inner elastic members 16 may define a continuous loop, or, alternatively, be non-continuous and connected to each other or the outer elastic member 14 by conventional means including stitching, adhesives or the like. The inner elastic members 16 may have various cross-sectional dimensions or shapes including, e.g., circular, oval or polygonal. In one embodiment, the combined cross-sectional dimension of the inner elastic members 16 occupies a substantial portion of the cross-sectional area, e.g., the internal dimension $OD_I$, of the interior volume 18 of the outer elastic member 14. This enhances the structural stability of the accessory apparatus 10 and also may minimize effects of radial deformation of the outer elastic member 14. In the embodiment depicted in FIGS. 1-3, the cross-sectional shape of the inner elastic members 16 is annular, e.g., oval. In the alternative, the cross-sectional shape of each inner elastic member 16 may be circular. In one embodiment, the cross-sectional dimension of the inner elastic members 16 may approximate about ½ of the inner cross-sectional dimension $OD_I$ of the outer elastic member 14 such that the combined cross-sectional dimension of both the inner elastic members 16 approximates the internal dimension $OD_I$ of the outer elastic member 14. Other dimensions or cross-sectional shapes are envisioned. For example, the cross-sectional dimensions of each of the inner elastic members 16 may be less or more than ½ of the inner cross-sectional dimension $OD_I$ of the outer elastic member 14.

The construction of the outer and inner elastic members 14, 16 of the accessory apparatus 10 provides a device that possesses sufficient rigidity to be worn on the wrist or ankle of a subject while maintaining its single looped configuration, and also exhibits sufficient flexibility to be looped two or more times about hair (e.g., a ponytail) to function as a hair retainer or ponytail holder. It is contemplated that the tubular or hollow configurations of the outer and inner elastic members 14, 16, with or without the filler material 22, accommodates, compensates and/or adjusts to the forces exerted on the accessory apparatus 10 during the looping process for application to hair, and will transition or return to its normal predefined stable (e.g., relatively rigid) single looped configuration upon removal of the forces without any deformation. Moreover, the accessory apparatus 10 may readily transition between the single loop and multi-loop configurations with relative ease and effort required on behalf of the subject. The inner elastic members 16 provide support to the outer elastic member 14 to maintain the integrity of the single loop condition of the accessory apparatus. On the other hand, the hollowed cross-section of each of the inner elastic members 16 reduces the volume of material to be deformed when the accessory apparatus 10 is looped upon itself, thus facilitating manipulation and application about hair.

As indicated hereinabove, the accessory apparatus 10 may also include a decorative element 100, which, in one embodiment, is mounted to the outer surface of the outer elastic member 14. The decorative element 100 may be secured to the outer elastic member 14 or may be mounted in a manner permitting reciprocal movement along the outer elastic member 14. With reference again to FIG. 1, in one preferred embodiment, the decorative element 100 is a jewelry or decorative item in the form of a chain which is wrapped about the outer surface of the outer elastic member 14, e.g., in a helical manner. Other orientations of the chain are also envisioned including an overlapping arrangement, zig-zag or the like. The chain may be solid or contain loops or openings 102 along its length. The chain possesses sufficient flexibility to be wrapped about the outer elastic member 14 and to not interfere with transition of the accessory apparatus 10 to its multi-looped configuration for application about hair. The openings 102 may enhance the flexible characteristics of the chain.

Figure 5:
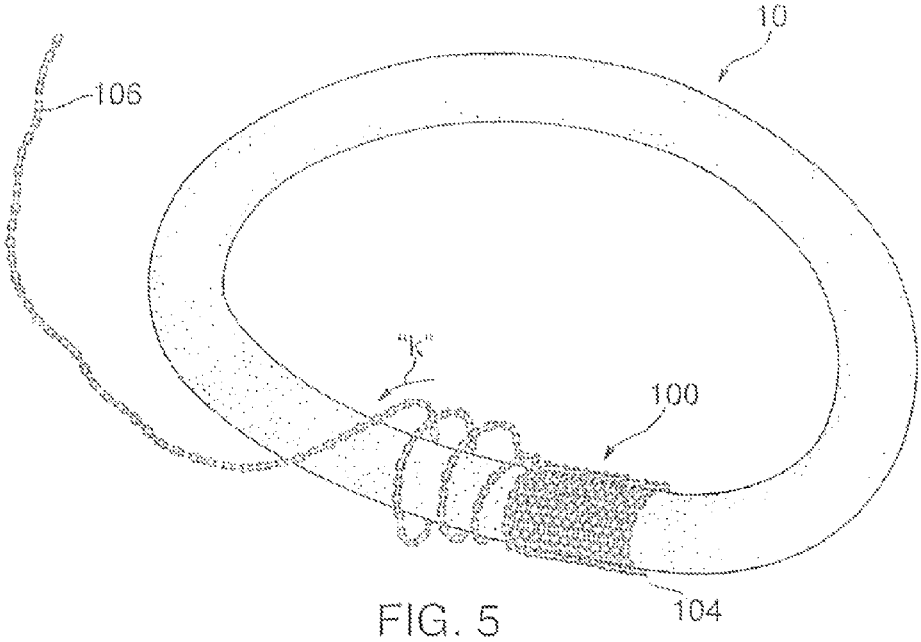
FIG. 5 is a view of the accessory apparatus of FIG. 1 illustrating one method for mounting the decorative element about the outer elastic member.
Figure 6:
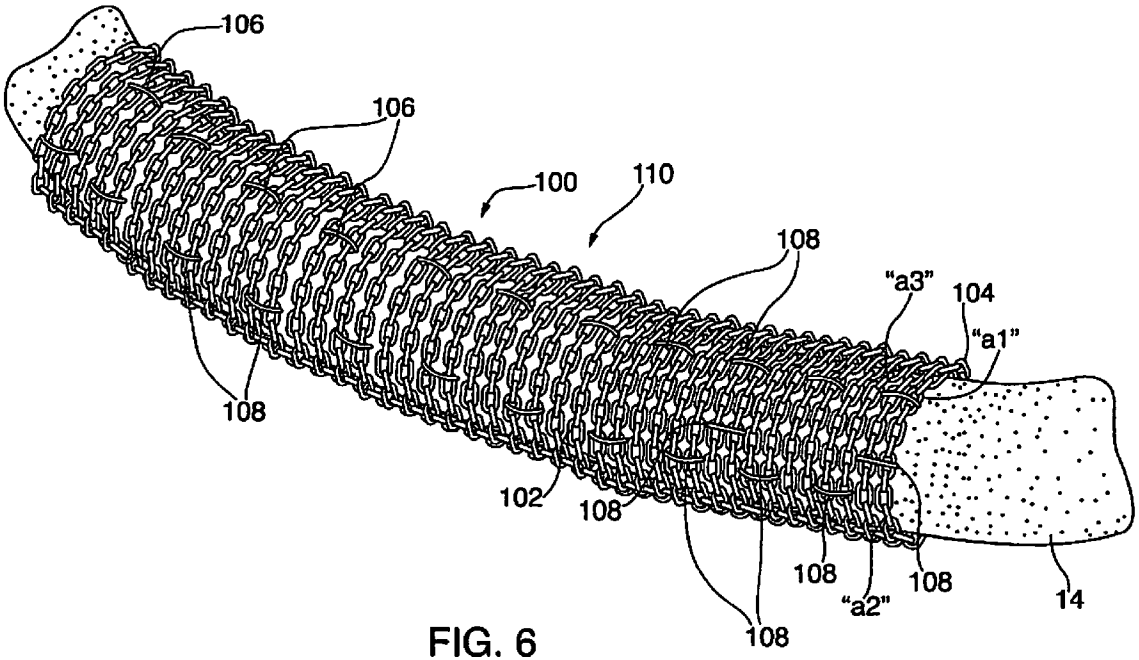
FIG. 6 is an enlarged view illustrating securing of the decorative element to the outer elastic member.

With reference to FIGS. 5-6, in one method of assembly, the decorative element 100, in the form of a chain, is held or secured at one end 104, while the other end 106 is looped about the outer elastic member 14 in the direction of directional arrow "k" of FIG. 5 until the chain is at least partially, or fully, wrapped about the outer elastic member 14 in, e.g., a helical manner. The chain is then secured to the outer elastic member 14. In one embodiment depicted in the enlarged view of FIG. 6, a plurality of fasteners 108 is secured through about adjacent loop segments "a1", "a2", "a3", etc. of the chain along the circumference of the outer elastic member 14. The fasteners 108 may be arranged in alternating manner about the outer surfaces of the adjacent loop segments ("a1", "a2", "a3", "a4" . . . ) or may be secured through the openings 102 of the chain. In one methodology, a number of fasteners 108 may be secured in radial spaced relation about the outer surfaces of adjacent loop segments ("a1", "a2", "a3", "a4" . . . ) at, e.g., 30°, 45°, 60°, 90° or 120° intervals. Other intervals are also envisioned. It is also envisioned that a fastener 108 may encompass more than two loop segments "a1", "a2", "a3", e.g., span across three or more loop segments. Other arrangements are also envisioned. In one embodiment, only the ends 104, 106 of the chain (e.g., the first three loops "a1", "a2", "a3") of each end 104, 106 are secured while the middle section 110 of the chain is unsecured. In other embodiments, the fasteners 108 may be disposed along the length of the chain. The fasteners 108 employed may include any material having sufficient rigidity to retain the chain on the outer elastic member 14 during multiple transitions of the accessory apparatus between the single loop and multi-loop configurations. For example, the fasteners 108 may be formed of a thread or filament and comprised of a natural material or a synthetic material such as nylon or the like. The fasteners 108 may be stitched via conventional means through at least the outer elastic member 14. The fasteners 108 may be transparent in whole or part.

In other embodiments, the decorative element 100 may include an annular sleeve which, at least partially or fully surrounds the outer elastic member 14. The sleeve may be fabricated from a fabric, elastomer and/or metallic material, and may contrast with the appearance of the outer elastic member 14 to enhance the visual effect of the accessory apparatus 10. At least part of, or the entire, the sleeve of the decorative element 100 may be flexible to permit positioning about the wrist, ankle and/or the hair of the subject. In the alternative, the decorative element 100 may be rigid provided the decorative element 100 is not too large to obstruct looping of the accessory apparatus 10 about the ponytail or hair of the subject.

With continued reference to FIGS. 2-4, the accessory apparatus 10 further may include at least one primary weight 24 which may be embedded within the outer elastic member 14 and/or the inner elastic members 16. In one embodiment, the primary weight 24 is secured to an interior surface of the outer elastic member 14. The primary weight 24 may be fabricated from any material including a metal, textile or polymeric material. The primary weight 24 may be flexible to not interfere with looping of the accessory apparatus 10, or may be rigid. It is contemplated that a rigid weight would be small in dimension to not interfere with manipulation of the accessory apparatus 10. In an embodiment, the primary weight 24 is positioned in diametrical opposed relation with respect to the decorative element 100. In this position, the primary weight 24 may facilitate orientation of the decorative element 100 in an outward manner when the accessory apparatus 10 is positioned loosely on the wrist. The accessory apparatus 10 optionally may include supplemental weights 26 positioned at a 180° interval or at 90° intervals with respect to the primary weight 24. The supplemental weights 26 may also facilitate presentation of the decorative element 100 in an outward manner. In the alternative, the accessory apparatus 10 may be devoid of weights and still operate in the desired manner. As a further alternative, a weight may be mounted within or adjacent to the decorative element 100.

Figure 7:
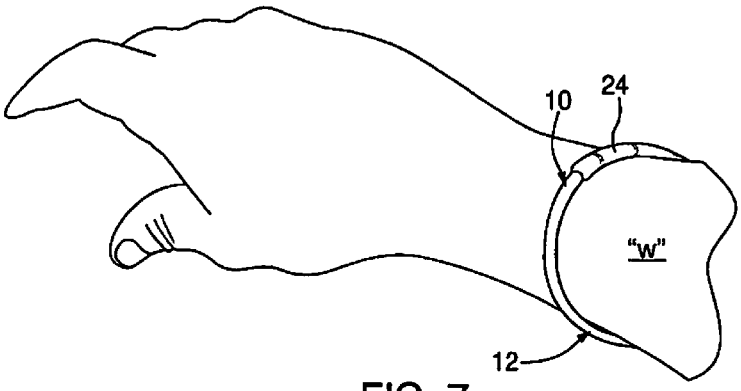
FIG. 7 is a view of the accessory apparatus in the form of a bracelet worn about the wrist of a subject.

FIG. 7 illustrates the accessory apparatus 10 in a first condition, e.g., in the single loop configuration, and positioned on the wrist "w" of the subject as a wristlet or bracelet. The accessory apparatus 10 may be positioned such that the decorative element or chain 100 faces outwardly away from the palm of the hand for visualization. The primary and/or supplemental weights 24, 26 may facilitate the outward orientation of the decorative element 100 as discussed hereinabove. In the single loop configuration, the accessory apparatus 10 is sufficiently rigid to maintain its predefined loop without buckling, collapsing or the like as provided by the structural characteristics of the hollow outer and inner elastic members 14, 16 discussed hereinabove.

Figure 8:
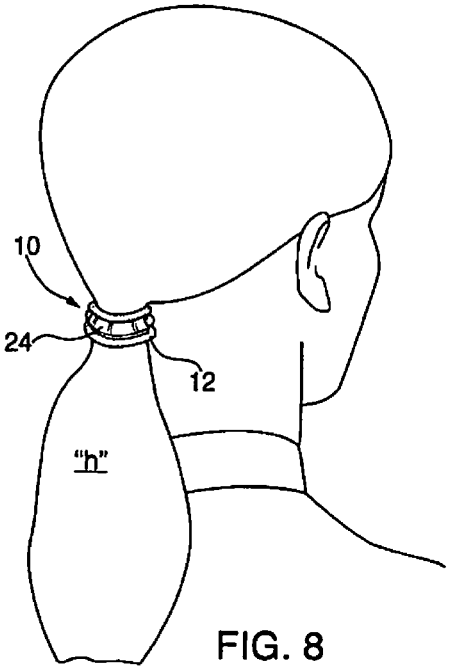
FIG. 8 is a view of the accessory apparatus in the form of a ponytail holder worn about a ponytail of the subject.

FIG. 8 illustrates the accessory apparatus 10 in a second condition, in the multi-loop configuration, and positioned about the ponytail or hair "h" of the subject as a ponytail or hair retainer. As discussed hereinabove, looping of the accessory apparatus 10 is readily achievable through the construction of the outer and inner elastic members 14, 16. The decorative element 100 may be arranged to face outwardly for visualization.

Persons skilled in the art will understand that the devices and methods specifically described herein and illustrated in the accompanying drawings are non-limiting exemplary embodiments. It is envisioned that the elements and features illustrated or described in connection with one exemplary embodiment may be combined with the elements and features of another without departing from the scope of the present disclosure. As well, one skilled in the art will appreciate further features and advantages of the disclosure based on the above-described embodiments. Accordingly, the disclosure is not to be limited by what has been particularly shown and described.

What is claimed is:

1. An accessory apparatus, which comprises:

an outer elastic member;

first and second inner elastic members disposed within the outer elastic member, the first and second inner elastic members being in side by side and contacting relation along an entirety of a circumference of the outer elastic member when in an unstressed condition, the first and second inner elastic members each defining a hollow interior, the hollow interiors of the first and second inner elastic members each having filler material disposed therewithin;

a decorative fashion item mounted about the outer elastic member; and at least one weight disposed within the outer elastic member.

2. The accessory apparatus according to claim 1 wherein the filler material includes filler yarns or threads.

3. The accessory apparatus according to claim 1 wherein the filler material includes foam.

4. The accessory apparatus according to claim 1 wherein the at least one weight is mounted in general diametrical opposed relation to the decorative fashion item.

5. The accessory apparatus according to claim 4 wherein the at least one weight is spaced from the first and second inner elastic members when in the unstressed condition.

6. The accessory apparatus according to claim 1 wherein the first and second inner elastic members are each a continuous band.

7. The accessory apparatus according to claim 1 wherein the outer elastic member and the first and second inner elastic members are configured to be worn on a wrist in a single loop configuration and configured to be worn about a ponytail in a multi-loop configuration.

8. A convertible bracelet and hair retainer, which comprises:

a continuous band having sufficient flexibility and being configured to transition between a single-loop bracelet to be worn on a wrist and a multi-looped hair retainer for retaining hair, the continuous band including a continuous outer elastic member, and first and second continuous inner elastic members disposed within the outer elastic member in side by side relation, at least one of the first and second inner elastic members defining a hollow interior having filler material disposed therein, the first and second inner elastic members being in direct contacting relation along a majority of a length of the continuous band when in an unstressed condition;

a decorative element secured to an outer surface of the outer elastic member; and at least one weight disposed within the outer elastic member.

9. The convertible bracelet and hair retainer according to claim 8 wherein the first and second inner elastic members are in direct contacting relation along an entire length of the continuous band when in an unstressed condition.

10. The convertible bracelet and hair retainer according to claim 8 wherein the at least one weight is spaced from the first and second inner elastic members when in the unstressed condition.

* * * * *